US010379463B2

(12) United States Patent
Suzuki et al.

(10) Patent No.: US 10,379,463 B2
(45) Date of Patent: Aug. 13, 2019

(54) TRANSFER UNIT AND IMAGE FORMING APPARATUS

(71) Applicant: CANON KABUSHIKI KAISHA, Tokyo (JP)

(72) Inventors: Yoshimi Suzuki, Numazu (JP); Takateru Ohkubo, Susono (JP); Kazuki Takase, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/141,715

(22) Filed: Sep. 25, 2018

(65) Prior Publication Data

US 2019/0094763 A1 Mar. 28, 2019

(30) Foreign Application Priority Data

Sep. 27, 2017 (JP) ..... 2017-187131

(51) Int. Cl.
*G03G 15/16* (2006.01)

(52) U.S. Cl.
CPC ..... *G03G 15/1615* (2013.01)

(58) Field of Classification Search
CPC ..... G03G 15/1615
See application file for complete search history.

(56) References Cited

U.S. PATENT DOCUMENTS

2013/0064572 A1* 3/2013 Shiba ..... G03G 15/0189 399/121
2014/0016965 A1* 1/2014 Tachiki ..... G03G 15/0189 399/121
2015/0309447 A1* 10/2015 Suzuki ..... G03G 15/1605 399/121
2015/0314976 A1* 11/2015 Hozumi ..... G03G 15/1615 198/806
2016/0091836 A1* 3/2016 Omata ..... G03G 15/1615 399/43
2017/0068190 A1* 3/2017 Hara ..... G03G 15/1615
2017/0075262 A1* 3/2017 Ebe ..... G03G 15/1665
2017/0185006 A1* 6/2017 Matsushita ..... G03G 15/1615
2017/0242387 A1* 8/2017 Hozumi ..... B65H 5/021
2018/0011430 A1* 1/2018 Yang ..... G03G 15/1615
2018/0039221 A1* 2/2018 Nakamoto ..... G03G 15/1615
2018/0112762 A1* 4/2018 Nieda ..... G03G 15/2032
2018/0267437 A1* 9/2018 Hozumi ..... G03G 15/1615
2018/0292775 A1* 10/2018 Hayakawa ..... G03G 15/5054

FOREIGN PATENT DOCUMENTS

JP 2001-272864 A 10/2001
JP 2002-072700 A 3/2002
JP 2002072700 A * 3/2002
JP 2015-210411 A 11/2015
JP 2016-224265 A 12/2016

* cited by examiner

*Primary Examiner* — Sevan A Aydin
(74) *Attorney, Agent, or Firm* — Canon U.S.A., Inc. IP Division

(57) ABSTRACT

A separation cam is disposed on a shaft of an opposing roller. The separation cam rotates about the shaft in response to a separation unit separating an intermediate transfer belt from a photosensitive drum, and the separation cam thereby separates a secondary transfer roller from the intermediate transfer belt.

18 Claims, 9 Drawing Sheets

TRANSFER UNIT AND IMAGE FORMING APPARATUS

BACKGROUND OF THE INVENTION

Field of the Invention

The present disclosure relates to an image forming apparatus, such as a copier, a printer, a facsimile, and a multifunction printer, which performs image forming by using an electrophotographic process and also relates to a transfer unit.

Description of the Related Art

A color image forming apparatus that employs an electrophotographic process includes pressure contact members, such as a primary transfer member and a secondary transfer member, that are urged by respective urging units and pressed on the surface of an endless belt, such as a transfer belt, at predetermined pressures. If such pressure contact members are pressed on the transfer belt and left as they are for a long period of time, the transfer belt is subjected to plastic deformation similar to curling-habit formation due to a creep phenomenon.

If the plastic deformation similar to the curling-habit formation occurs in the transfer belt, the deformation degrades the state of contact between the transfer belt and a photosensitive drum, which serves as an image bearing member, and also degrades the state of contact between the transfer belt and a secondary transfer member. This may lead to a transfer defect. To deal with this circumstance, a configuration has been proposed, in which the secondary transfer member is separated from the transfer belt while the transfer belt is stopped in such cases that the apparatus is on standby for printing or powered off.

Japanese Patent Laid-Open No. 2015-210411 discloses a configuration in which a lever member, which is a separation unit that separates a photosensitive drum and a transfer belt from each other, includes an arm portion that separates a secondary transfer member from the transfer belt. According to this configuration, movement of the lever member releases an urging force of a primary transfer member that applies to the photosensitive drum and thereby separate the photosensitive drum and the transfer belt from each other. Simultaneously, the arm portion can separate the transfer belt and the secondary transfer member from each other by pressing the secondary transfer member.

The pressing force of the secondary transfer member applied to the transfer belt tends to be set high to improve the state of contact between the transfer belt and a transfer medium, such as a sheet of paper and an OHP sheet. Thus, a separation member for separating the secondary transfer member is subjected to a large load. With the configuration according to Japanese Patent Laid-Open No. 2015-210411, it is possible to perform separation operation of the secondary transfer member. However, it is desired to further reduce the load applied to a separation unit.

SUMMARY OF THE INVENTION

The present disclosure provides an image forming apparatus that has a configuration in which the separation unit that separates an image bearing member and a transfer belt from each other also separates a secondary transfer member from the transfer belt and thereby a load exerted on the separation unit can be reduced.

The present disclosure provides an image forming apparatus that includes an image bearing member configured to bear a toner image, a transfer belt that is movable and comes into contact with the image bearing member, a first contact member that comes into contact with an inner peripheral surface of the transfer belt and is configured to press the transfer belt toward the image bearing member, a secondary transfer member that comes into contact with an outer peripheral surface of the transfer belt and thereby forms a secondary transfer portion, an opposing member that is disposed at a position opposing the secondary transfer member with the transfer belt interposed therebetween, an urging member configured to urge the secondary transfer member toward the opposing member, and a separation unit configured to separate the transfer belt from the image bearing member by switching a pressing state of the first contact member. In the image forming apparatus, the separation unit includes a rotating member that rotates about a rotation axis of the opposing member and thereby moves the secondary transfer member in a direction opposite to an urging direction of the urging member and separates the secondary transfer member from the transfer belt.

Further features of the present disclosure will become apparent from the following description of exemplary embodiments with reference to the attached drawings.

DESCRIPTION OF THE EMBODIMENTS

Embodiments of the disclosure will be described with reference to the drawings. Note that dimensions, materials, shapes, relative positions, or the like, of elements described in the embodiments below are to be changed appropriately in accordance with configurations and various conditions of an apparatus to which the present disclosure is applied, and accordingly, the embodiments described below should not be construed as limiting the disclosure.

First Embodiment

Configuration of Image Forming Apparatus

Figure 1:
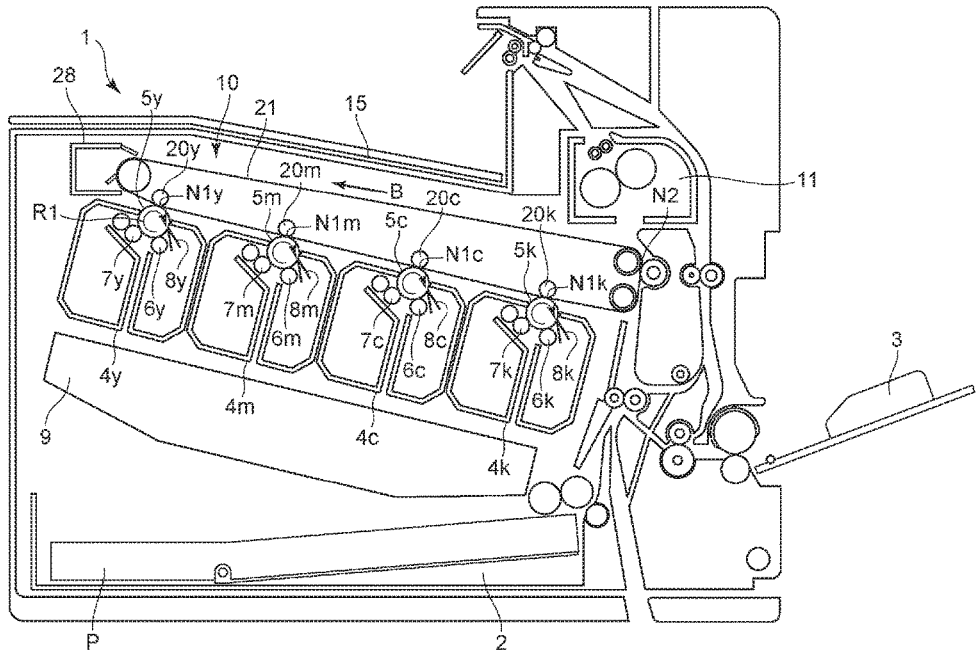
FIG. 1 is a cross-sectional view schematically illustrating an image forming apparatus according to a first embodiment.

FIG. 1 is a cross-sectional view schematically illustrating an image forming apparatus 1 according to the present embodiment. The image forming apparatus 1 according to the present embodiment is a color image forming apparatus that employs an electrophotographic process and an intermediate image transfer system. The image forming apparatus 1 has a first image forming section 4*y*, a second image forming section 4*m*, a third image forming section 4*c*, and a fourth image forming section 4*k*, which serve as a plurality of image forming units. The first, second, third, and fourth image forming sections 4*y*, 4*m*, 4*c*, and 4*k* serve to form respective color images of yellow, magenta, cyan, and black. As illustrated in FIG. 1, the four image forming sections 4*y*, 4*m*, 4*c*, and 4*k* are arranged in a row with a constant spacing provided between adjacent image forming sections.

Note that in the present embodiment, the configurations of the first to fourth image forming sections 4*y* to 4*k* are substantially the same except for the colors of toners to be used. Accordingly, when it is not necessary to focus on differences, image forming sections 1 will be described collectively by omitting suffixes y, m, c, and k, which indicate that corresponding elements are provided for individual colors.

As illustrated in FIG. 1, the image forming sections 4 include respective drum-type electrophotographic photoreceptors 5 (hereinafter referred to as "photosensitive drums 5"), each of which is rotatable in the direction of arrow R1 and serves as a first image bearing member on which a toner image is formed. Each image forming section includes a charging roller 6 serving as a unit for charging the photosensitive drum 5, a development roller 7 serving as a development unit, and a cleaning blade 8 serving as a cleaning unit. These elements are disposed around the photosensitive drum 5. In addition, an exposure unit 9 is disposed in the image forming apparatus 1 at a position downstream of the charging roller 6 and upstream of the development roller 7 with respect to the rotation direction of the photosensitive drum 5. The exposure unit 9 exposes the photosensitive drum 5 to light by irradiating the photosensitive drum 5 with light corresponding to image information.

A transfer unit 10 is disposed at a position opposing the image forming sections 4.

Figure 2:
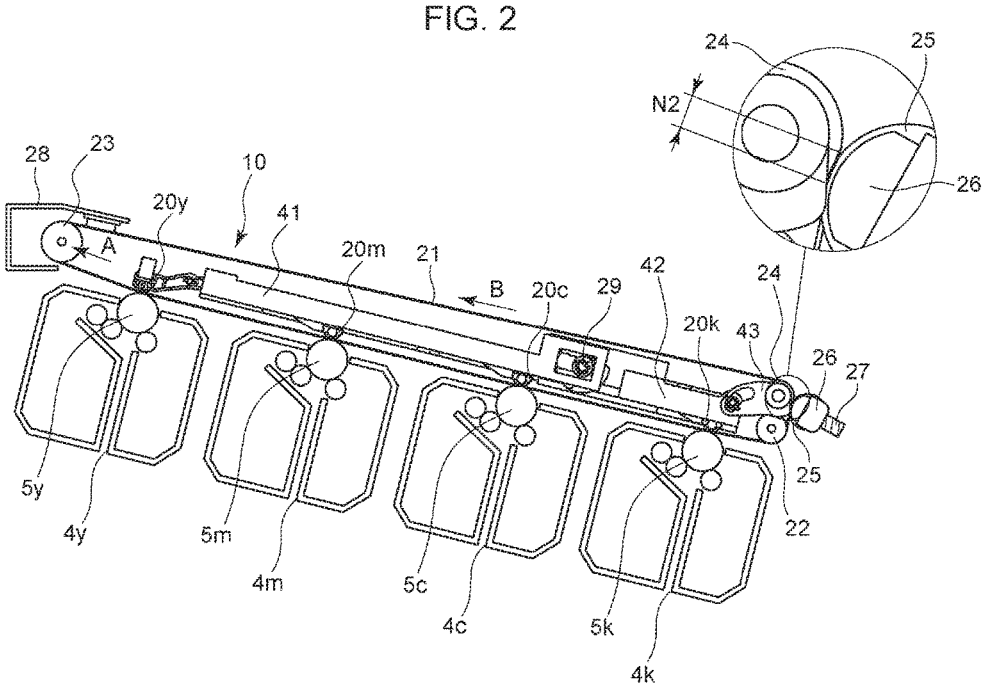
FIG. 2 is a cross-sectional view schematically illustrating a transfer unit according to the first embodiment and the vicinity of the transfer unit.

The transfer unit 10 is a unit that can be mounted in, and detached from, the image forming apparatus 1. FIG. 2 is a cross-sectional view schematically illustrating the transfer unit 10 and members disposed around the transfer unit 10.

As illustrated in FIG. 2, an intermediate transfer belt 21 (transfer belt) is disposed at a position that opposes the photosensitive drums 5. The intermediate transfer belt 21 is an endless-belt-type intermediate transfer member. The intermediate transfer belt 21 extends around extension rollers 22 and 23, which serve as a plurality of support members. The intermediate transfer belt 21 also extends around an opposing roller 24 for secondary-transfer (hereinafter referred to as an opposing roller 24), which serve as an opposing member. The extension roller 23 is urged in the direction of arrow A by an urging unit (not illustrated), which thereby imparts a predetermined tension to the intermediate transfer belt 21. The opposing roller 24 rotates by receiving a driving force from a drive source (not illustrated), which causes the intermediate transfer belt 21 to move at a predetermined speed in the direction of arrow B.

Primary transfer rollers 20*y*, 20*m*, 20*c*, and 20*k*, which serve as primary transfer members (contact members), are disposed along the inner peripheral surface of the intermediate transfer belt 21 so as to oppose the respective photosensitive drums 5 of the image forming sections 4. In addition, a secondary transfer roller 25, which serves as a secondary transfer member, is disposed on the outer peripheral surface of the intermediate transfer belt 21 so as to oppose the opposing roller 24.

The intermediate transfer belt 21 is made of a resin, such as polyvinylidene difluoride (PVDF), ethylene-tetrafluoroethylene copolymer (ETFE), polyimide resin, polyethylene terephthalate (PET), and polycarbonate. Alternatively, the intermediate transfer belt 21 can be formed as an endless belt that has a rubber base layer made of, for example, ethylene-propylene-diene rubber (EPDM), and the surface of the rubber base layer is covered by urethane rubber in which a fluorocarbon polymer, such as polytetrafluoroethylene (PTFE), is dispersed.

The primary transfer rollers 20 are disposed at positions opposing respective photosensitive drums 5 with the intermediate transfer belt 21 interposed therebetween. The primary transfer rollers 20 press the intermediate transfer belt 21 against the photosensitive drums 5, thereby forming respective primary transfer portions N1 (contacting position). The primary transfer rollers 20 rotate passively in accordance with movement of the intermediate transfer belt 21. In addition, primary transfer power supplies (not illustrated) are connected to the primary transfer rollers 20. The primary transfer power supplies apply a voltage having positive or negative polarity to the respective primary transfer rollers 20.

The secondary transfer roller 25 is formed of, for example, an elastic member, such as a foam rubber member. In the present embodiment, a nickel-plated steel bar that had a diameter of 6 mm and was covered by nitrile rubber (NBR) and epichlorohydrin rubber to a thickness of 6 mm was used as the secondary transfer roller. The secondary transfer roller 25 comes into contact with the intermediate transfer belt 21 at a position opposing the opposing roller 24 and thereby forms a secondary transfer portion N2. A secondary transfer power supply (not illustrated) is connected to the secondary transfer roller 25. The secondary transfer power supply applies a voltage having positive or negative polarity to the secondary transfer roller 25.

As illustrated in FIG. 2, a collection unit is disposed downstream of the secondary transfer portion N2 with respect to the moving direction of the intermediate transfer belt 21. The collection unit 28 collects residual toner remaining on the intermediate transfer belt 21. In addition, as illustrated in FIG. 1, the image forming apparatus 1 includes a cassette 2 that can be withdrawn from the apparatus. The cassette 2 accommodates transfer media P, such as sheets of paper and OHP sheets. The image forming apparatus 1 also includes a manual feed tray 3 that is disposed on the right side of the apparatus in FIG. 1 and on which transfer media P can be loaded. The transfer media P accommodated in the cassette 2 or the manual feed tray 3 are separated one by one, and each transfer medium P is conveyed toward the secondary transfer portion N2. In addition, a fixing unit 11 equipped with a heat source is disposed downstream of the secondary transfer portion N2 with respect to the conveying direction of the transfer medium P.

Image Forming Operation

In the present embodiment, when performing a mode for forming a monochrome image on a transfer medium P (monochrome mode), the image forming section 4*k* in which a black toner is accommodated is used. In the monochrome mode, rotation of the photosensitive drums 5*y*, 5*m*, and 5*c* is stopped in order to avoid wear of the photosensitive drums 5 that do not bear toner images. In this case, in the present embodiment, the intermediate transfer belt 21 is separated from the photosensitive drums 5*y*, 5*m*, and 5*c* at the respective primary transfer portions N1*y*, N1*m*, and N1*c* in order to prevent sliding contact between the intermediate transfer belt 21 that is rotatably moving and the photosensitive drums 5*y*, 5*m*, and 5*c*.

On the other hand, when performing a mode for forming a full-color image (full-color mode), the image forming sections 4*y*, 4*m*, 4*c*, and 4*k* are used. Accordingly, image forming is performed while all of the photosensitive drums 5 are in contact with the intermediate transfer belt 21. Image forming operation of the image forming apparatus 1 will be described with reference to FIG. 1 by taking the full-color mode as an example.

When a signal for starting image forming is issued, the photosensitive drums 5 are rotationally driven at a predetermined circumferential velocity in the direction of arrow R1 in FIG. 1. During the rotation, the photosensitive drums 5 are electrically charged by the respective charging rollers 6 so as to generate a uniform potential distribution on the surfaces of the drums. Each charging roller 6, which is in contact with the corresponding photosensitive drum 5 at a predetermined contact pressure, charges the surface of the photosensitive drum 5 uniformly to a predetermined potential while a charging power supply (not illustrated) applies a predetermined voltage to the charging roller 6. In the present embodiment, the charging roller 6 charges the photosensitive drum 5 to a negative polarity.

The exposure unit 9 exposes the surface of the photosensitive drum 5 to light and thereby forms an electrostatic latent image corresponding to image information on the surface of the photosensitive drum 5 that has been charged by the charging roller 6. More specifically, the exposure unit 9 outputs, from a laser output section, laser light modulated in accordance with a time-series electrical digital pixel signal of the image information that has been input from a host computer (not illustrated). The surface of the photosensitive drum 5 is subsequently irradiated with the laser light via a reflecting mirror. Thus, the electrostatic latent image is formed on the surface of the photosensitive drum 5.

While the development roller 7 is rotationally driven by a drive unit (not illustrated), toner born by the development roller 7 in a thin layer is conveyed to a development region where the development roller 7 and the photosensitive drum 5 are in contact with each other. A development power supply (not illustrated) applies a voltage to the development roller 7, which thereby develops the electrostatic latent image formed on the photosensitive drum 5 into a toner image.

The electrostatic latent image formed on the photosensitive drum 5 is developed by using a reversal development method. In other words, toner charged to the same polarity as the charging polarity of the photosensitive drum 5 (i.e., negative polarity in the present embodiment) adheres to the portion of the photosensitive drum 5 that has been exposed to light by the exposure unit 9. Thus, the electrostatic latent image is developed into a toner image. The normal charging polarity of the toner accommodated in the development roller 7 is negative.

Note that a contact development method is used in the present embodiment. However, a non-contact development method may be also used. In addition, the reversal development method is used in developing the electrostatic latent image in the present embodiment. However, the disclosure can be applied to an image forming apparatus that utilizes a positive development method for developing an electrostatic latent image by using toner charged to a polarity opposite to the charging polarity of the photosensitive drum 5.

The toner image developed on the photosensitive drum 5 is transferred (i.e., primary-transferred) from the photosensitive drum 5 onto the intermediate transfer belt 21 in the primary transfer portion N1 while a primary transfer power supply (not illustrated) applies a voltage having positive polarity, which is the polarity opposite to the normal charging polarity of toner, to the corresponding primary transfer roller 20. Thus, in each primary transfer portion N1, the toner image of each color is primary-transferred onto the intermediate transfer belt 21, and thus the toner images are overlaid on each other. Consequently, a multilayered toner image composed of the toner images of a plurality of colors is formed on the intermediate transfer belt 21.

The leading edge of the multicolor toner image that has been primary-transferred onto the intermediate transfer belt 21 reaches the secondary transfer portion N2. In synchronization with this timing, a transfer medium P is conveyed to the secondary transfer portion N2 from the cassette 2 or the manual feed tray 3. In the secondary transfer portion N2, the entire multicolor toner image is secondary-transferred from the intermediate transfer belt 21 onto the transfer medium P while the secondary transfer power supply (not illustrated) applies a voltage having positive polarity, which is opposite to the normal charging polarity of toner, to the secondary transfer roller 25.

Subsequently, the transfer medium P to which the multicolor toner image has been secondary-transferred is heated and pressed at the fixing unit 11. As a result, the multicolor toners are fused and blended, and fixed on the transfer medium P. The transfer medium P on which the multicolor toner image has been fixed is discharged from the image forming apparatus 1 and stacked on a stacking tray 15, which serves as a stacking unit. Thus, a series of image forming operations are completed.

Residual toner remaining on the photosensitive drum 5 after the primary transfer is removed therefrom by a cleaning blade 8, which serves as a cleaning member. The cleaning blade 8 is a plate-like member formed of an elastic material such as urethane rubber. The toner that has not been secondary-transferred to the transfer medium P and has remained on the intermediate transfer belt 21 is moved by the intermediate transfer belt 21 and is consequently collected by the collection unit 28.

Separation Mechanism at Primary Transfer Portion and Secondary Transfer Portion

If the formation of a primary transfer portion N1 is maintained while the image forming apparatus 1 is on standby or powered off, the primary transfer roller 20 is left in a state of pressing against the corresponding photosensitive drum 5, which may cause the primary transfer roller 20 to be subjected to plastic deformation. If the primary transfer roller 20 is subjected to plastic deformation, the contact state between the corresponding photosensitive drum 5 and the intermediate transfer belt 21 at the primary transfer portion N1 may be degraded, which may lead to a transfer defect.

The secondary transfer roller 25 is rotatably supported by a secondary transfer bearing 26 (bearing member) illustrated in FIG. 2 at each end of the rotating shaft that extends in a direction intersecting the conveying direction of the transfer medium P. The secondary transfer roller 25 is pressed toward the opposing roller 24 by springs 27, which serve as urging members, with the intermediate transfer belt 21 interposed therebetween. A secondary transfer power supply (not illustrated) applies a relatively high voltage to the secondary transfer roller 25 at the secondary transfer portion N2 in order to form an electrical field for toner transfer in a transfer medium P that is difficult to conduct electricity.

Note that in the present embodiment, the secondary transfer portion N2 is formed such that the secondary transfer roller 25 is shifted slightly upstream of the opposing roller 24 in the conveying direction of the transfer medium P. This can widen the secondary transfer portion N2 in the conveying direction of the transfer medium P and can thereby suppress an image defect caused by the toner in the case of toner flying off.

If there is a small gap in the secondary transfer portion N2, the small gap may cause abnormal electric discharge. To avoid this and ensure close contact between the transfer medium P and the secondary transfer roller 25, springs that have a relatively strong urging force are used for the springs 27 that urge the secondary transfer roller 25. Accordingly, if the formation of the secondary transfer portion N2 is maintained for a long period of time, the intermediate transfer belt 21 may be subjected to a curling habit and lead to plastic deformation due to the strong urging force of the springs 27 at the secondary transfer portion N2. The plastic deformation at the primary transfer portions N1 and at the secondary transfer portion N2 are detrimental to the contact state between the intermediate transfer belt 21 and the photosensitive drums 5 and to the contact state between the intermediate transfer belt 21 and the secondary transfer roller 25. This may result in a transfer defect.

Accordingly, in the present embodiment, the image forming apparatus 1 includes a separation unit that can remove the primary transfer portions N1 and the secondary transfer portion N2 while the image forming apparatus 1 is on standby or powered off. A configuration and operation of the separation unit according to the present embodiment will be described in detail with reference to FIGS. 3 to 8.

Configuration of Separation Unit

Figure 3:
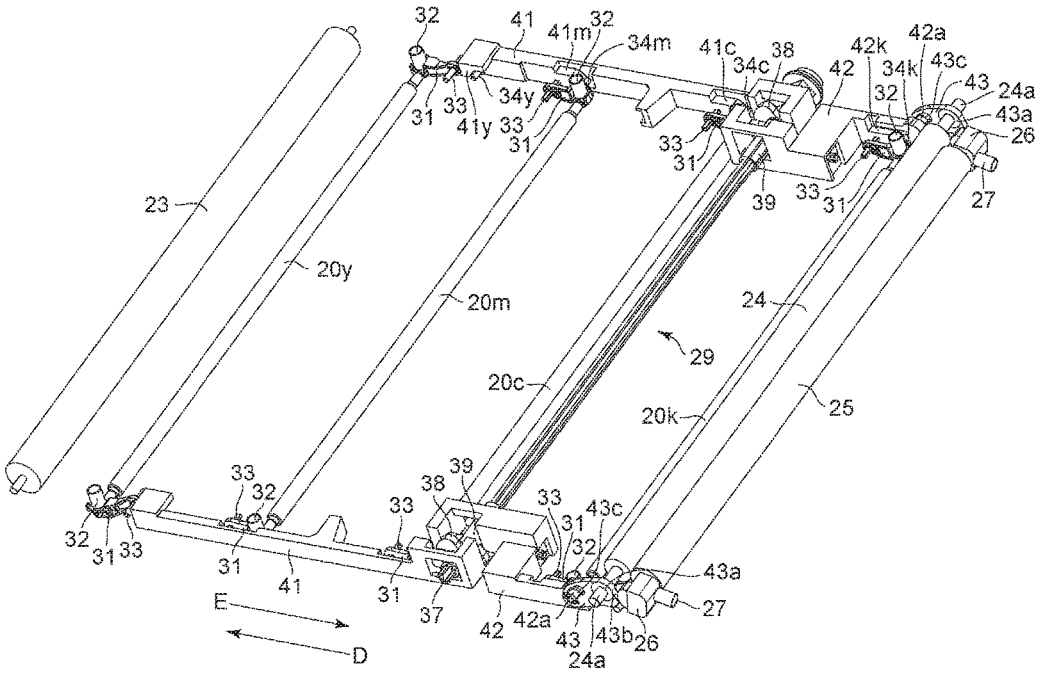
FIG. 3 is a perspective view schematically illustrating the transfer unit according to the first embodiment from which an intermediate transfer belt is removed.
Figure 4:
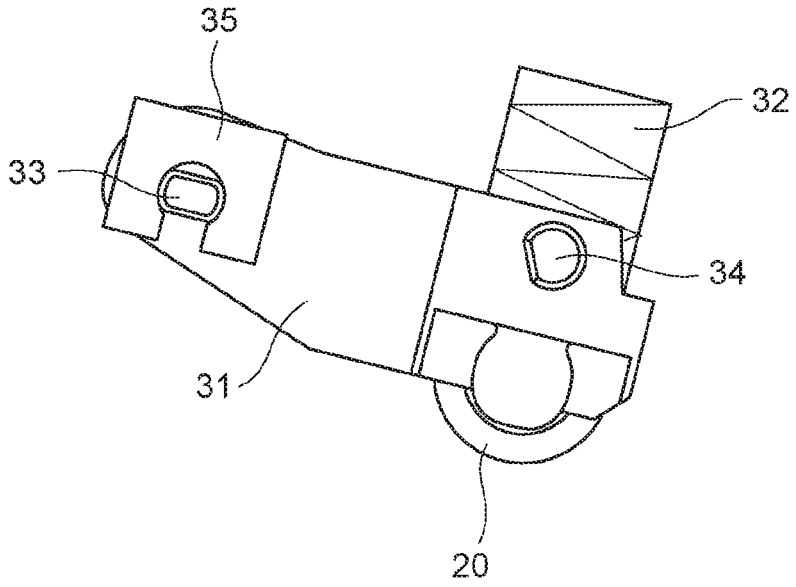
FIG. 4 is a diagram illustrating a primary transfer member according to the first embodiment.
Figure 5:
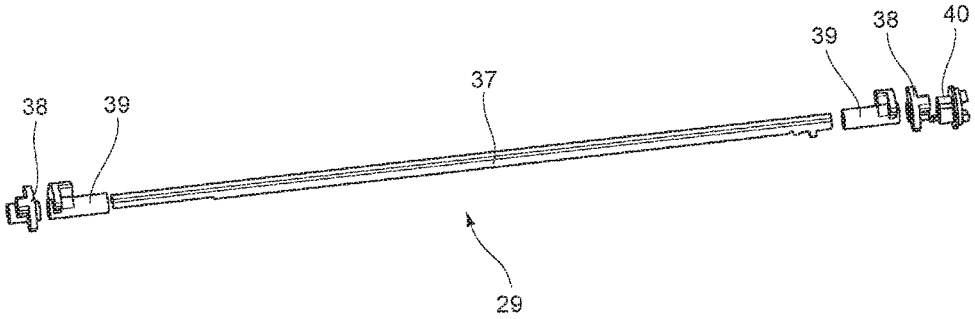
FIG. 5 is a diagram illustrating part of a separation unit according to the first embodiment.

FIG. 3 is a perspective view schematically illustrating the transfer unit 10 when viewed diagonally from above while the intermediate transfer belt 21 is removed. FIG. 4 is a diagram illustrating a configuration of a primary transfer bearing 31 in relation to separation operation of a primary transfer roller 20. FIG. 5 is a diagram illustrating a configuration of a separation shaft unit 29 of the separation unit.

As illustrated in FIG. 3, each of the primary transfer rollers 20 (20*y*, 20*m*, 20*c*, 20*k*) is rotatably supported by the primary transfer bearings 31 at both ends of the rotating shaft of the primary transfer roller 20. Each primary transfer roller 20 is urged by primary transfer springs 32 toward the corresponding photosensitive drum 5 with the intermediate transfer belt 21 interposed therebetween, which thereby forms the corresponding primary transfer portion N1. As illustrated in FIG. 4, each primary transfer bearing 31 has a pivot 33 and a boss 34. The pivot 33 is rotatably supported by a frame (not illustrated) of the transfer unit 10.

As illustrated in FIG. 5, the separation shaft unit 29 has a rotating shaft 37, first cams 38, second cams 39, and a coupling 40. The first and second cams 38 and 39 are disposed at both ends of the rotating shaft 37. The rotating shaft 37 is formed of a metal plate bent into a U-shape, and the first cams 38, the second cams 39, and the coupling 40 are fixed to the rotating shaft 37. The separation shaft unit 29 is rotatably supported by the frame (not illustrated) of the transfer unit 10 while a boss (not illustrated) disposed in each of the second cams 39 engages the frame (not illustrated).

The image forming apparatus 1 includes a drive transmission unit (not illustrated), which transmits driving power to the coupling 40 and thereby rotates the separation shaft unit 29. As illustrated in FIG. 3, the transfer unit 10 includes large levers 41 (second moving members) and small levers 42 (first moving members) that are disposed immediately outside the primary transfer bearings 31 within a frame (not illustrated) that is included in the transfer unit 10. The large levers 41 and the small levers 42 are disposed so as to be able to slide in the directions of arrow D and of arrow E. Each large lever 41 engages the first cam 38, and each small lever 42 engages the second cam 39. In addition, as illustrated in FIG. 2, the large lever 41 and the small lever 42 are disposed within a region surrounded by the inner peripheral surface of the intermediate transfer belt 21 so as not to protrude upward nor downward from the region.

The large lever 41 and the small lever 42 move reciprocally in the directions of arrow D and arrow E in FIG. 3 in synchronization with rotation of the separation shaft unit 29. The first cam 38, the large lever 41, and the small lever 42 are made of a resin that has a good sliding property. In the present embodiment, polyacetal resin is used. Each large lever 41 has contact surfaces 41*y*, 41*m*, and 41*c* that come into contact with respective bosses 34*y*, 34*m*, and 34*c*, and each small lever 42 has a contact surface 42*k* that comes into contact with the boss 34*k*.

Separation cams 43 (rotating members) are disposed at respective ends of the opposing roller 24. The separation cams 43 serve as cam members that separate the secondary transfer roller 25 from the intermediate transfer belt 21. Each separation cam 43 is rotatably attached, via a hole portion 43*a*, to a metal core 24*a* (hereinafter referred to as a shaft 24*a*) of the opposing roller 24. The separation cam 43 has a pressing portion 43*b* that presses a secondary transfer bearing 26 that supports the secondary transfer roller 25. The separation cam 43 also has a link portion 43*c* (engaged portion) that is connected to a rotating shaft 42*a* (engaging portion) disposed in the small lever 42.

Note that the large lever 41 and the small lever 42 located on the far side in the direction perpendicular to the image of FIG. 3 include elements having reference symbols. The same elements are disposed at the same positions on the large lever 41 and the small lever 42 on the near side in this direction.

In the present embodiment, the separation unit that includes the separation shaft unit 29, the large levers 41, the small levers 42, and separation cams 43 performs separation of the primary transfer rollers 20 and the secondary transfer roller 25 so as to remove the primary transfer portions N1 and the secondary transfer portion N2.

Separation Operation of Separation Unit

Figure 6:
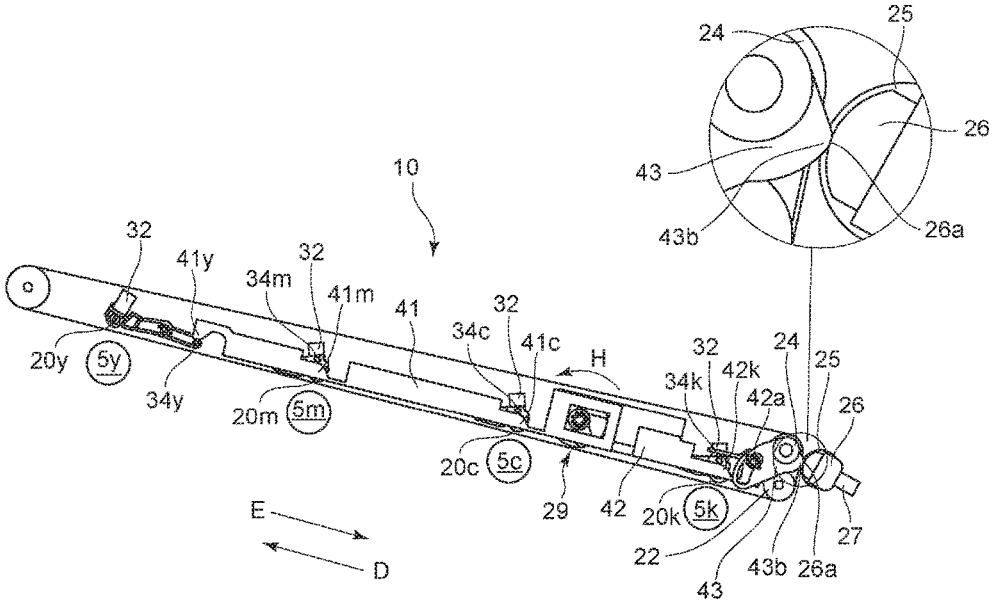
FIG. 6 is a diagram illustrating a state of the transfer unit when the separation unit separates the primary transfer member and a secondary transfer member in the first embodiment and in a second embodiment.
Figure 7:
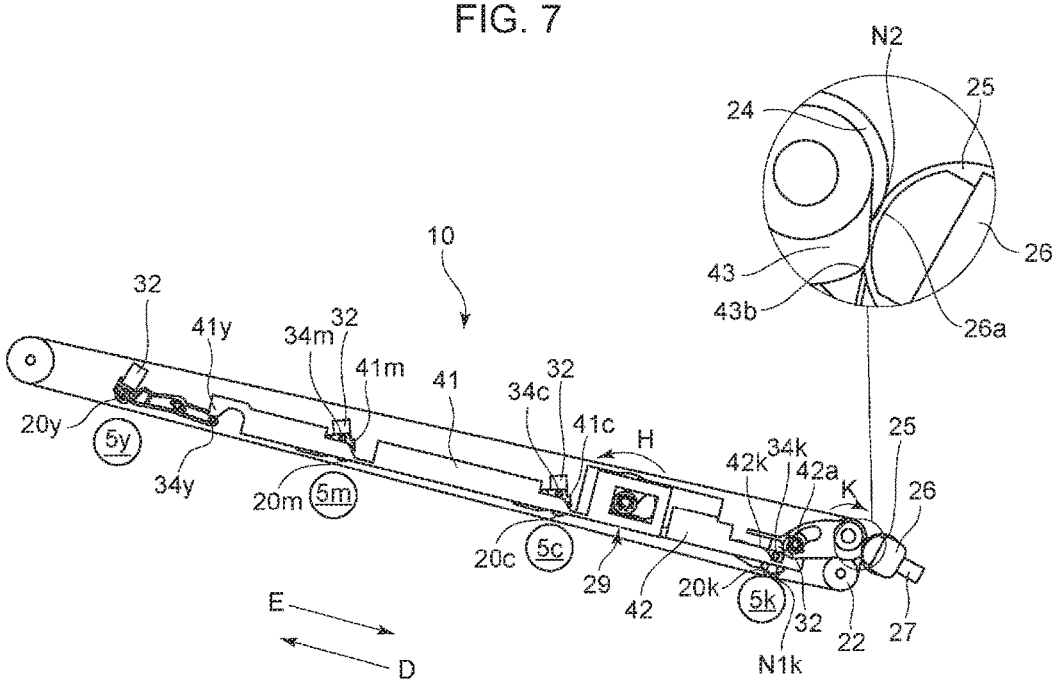
FIG. 7 is a diagram illustrating a state of the transfer unit when a monochrome image is formed in the first embodiment.
Figure 8:
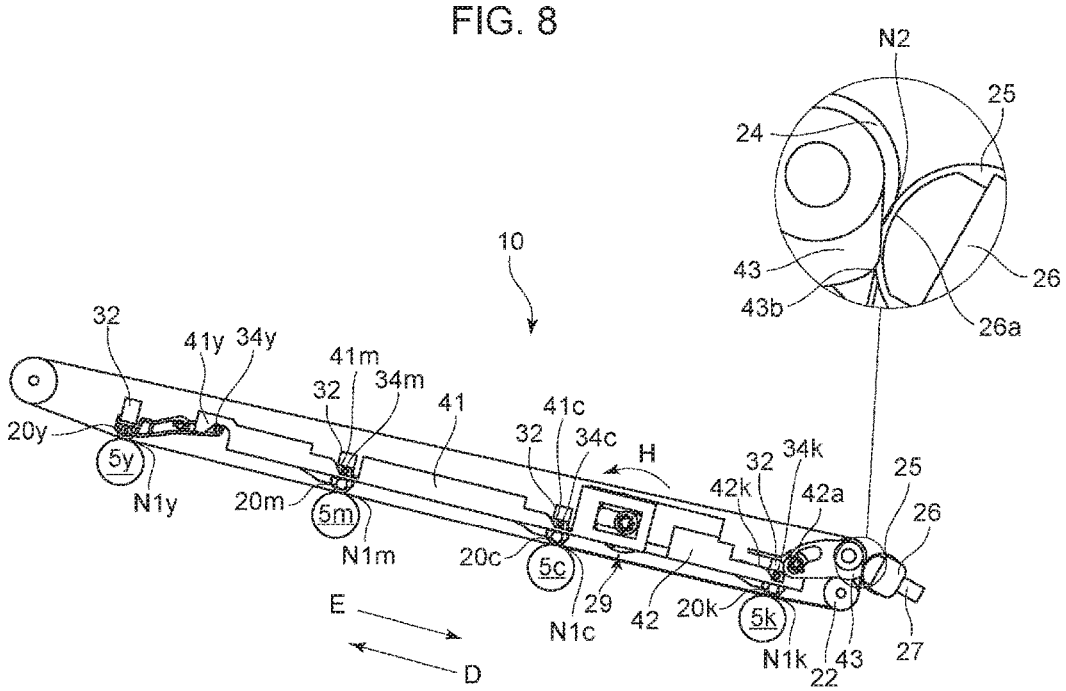
FIG. 8 is a diagram illustrating a state of the transfer unit when a full-color image is formed in the first embodiment.

FIG. 6 is a diagram illustrating a state where the separation unit separates the primary transfer rollers 20*y*, 20*m*, 20*c*, and 20*k* and the secondary transfer roller 25 from the intermediate transfer belt 21 while the image forming apparatus 1 is on standby or powered off. FIG. 7 is a diagram illustrating a state where, in the monochrome mode, the separation unit separates the primary transfer rollers 20*y*, 20*m*, and 20*c* from the intermediate transfer belt 21. FIG. 8 is a diagram illustrating a state where in the full-color mode, all of the primary transfer rollers 20 and the secondary transfer roller 25 are in contact with the intermediate transfer belt 21.

As illustrated in FIG. 6, while the image forming apparatus 1 is on standby or powered off, the boss 34*y* is in contact with the contact surface 41*y*, the boss 34*m* is in contact with the contact surface 41*m*, the boss 34*c* is in contact with the contact surface 41*c*, and the boss 34*k* is in contact with the contact surface 42*k*. Moreover, the pressing portion 43*b* disposed in each separation cam 43 presses a contact surface 26*a* disposed in the secondary transfer bearing 26 in a direction opposite to the urging direction of each spring 27. Thereby, the primary transfer rollers 20*y*, 20*m*, 20*c*, and 20*k* and the secondary transfer roller 25 are maintained to be separated from the intermediate transfer belt 21.

In the monochrome mode, when the image forming apparatus 1 receives an image signal for forming a monochrome image, the separation shaft unit 29 is rotated by 120 degrees in the direction of arrow H (counterclockwise) from the state illustrated in FIG. 6. As a result, rotation of each second cam 39 causes the corresponding small lever 42 to move in the direction of arrow D and causes the transfer unit 10 to assume the state illustrated in FIG. 7. Note that even when the separation shaft unit 29 is rotated by 120 degrees, each first cam 38 and the corresponding large lever 41 maintain the engagement state, and accordingly the large lever 41 does not move in the direction of arrow D.

When the small lever 42 moves in the direction of arrow D from the state illustrated in FIG. 6, the boss 34*k* is released from the state of engagement with the contact surface 42*k* as illustrated in FIG. 7. As a result, the primary transfer roller 20*k* is moved toward the intermediate transfer belt 21 due to the urging force of the corresponding primary transfer spring 32. The primary transfer roller 20*k* presses the photosensitive drum 5*k* with the intermediate transfer belt 21 interposed therebetween, thereby forming the primary transfer portion N1*k*.

Moreover, the movement of the small lever 42 also moves the rotating shaft 42*a* that engages the link portion 43*c* in the direction of arrow D. The separation cam 43 is thereby rotated about the shaft 24*a* of the opposing roller 24 in the direction of arrow K, which releases the pressing portion 43*b* from the state of contact with the contact surface 26*a*. As a result, the secondary transfer roller 25 is moved toward the intermediate transfer belt 21 due to the urging force of the spring 27, and the secondary transfer roller 25 presses the opposing roller 24 with the intermediate transfer belt 21 interposed therebetween, thereby forming the secondary transfer portion N2.

When the primary transfer and the secondary transfer are finished in the monochrome mode, the separation shaft unit 29 is rotated by 240 degrees in the direction of arrow H (counterclockwise) at a predetermined timing. Consequently, rotation of each second cam 39 causes the corresponding small lever 42 to move in the direction of arrow E. As a result, the boss 34*k* and the contact surfaces 42*k* are brought into contact with each other, and the primary transfer roller 20*k* is thereby switched from the state of pressing against the photosensitive drum 5*k* and the intermediate transfer belt 21. Simultaneously, the rotation of separation cam 43 causes the pressing portion 43*b* to press the contact surfaces 26*a*. As a result, all of the primary transfer rollers 20 and the secondary transfer roller 25 are separated from the intermediate transfer belt 21. Thus, the transfer unit 10 assumes the state of standby or power-off as illustrated in FIG. 6.

On the other hand, in the full-color mode, when the image forming apparatus 1 receives an image signal for forming a full-color image, the separation shaft unit 29 is rotated by 240 degrees in the direction of arrow H (counterclockwise) from the state illustrated in FIG. 6. As a result, each large lever 41 is moved in the direction of arrow D due to the rotation of the corresponding first cam 38, while each small lever 42 is moved in the direction of arrow D due to the rotation of the corresponding second cam 39. The contact operation in which the small lever 42 brings the primary transfer roller 20*k* and the secondary transfer roller 25 into contact with the intermediate transfer belt 21 is the same as that in the case in FIG. 7, and duplicated description is thereby omitted.

When the large lever 41 is moved in the direction of arrow D from the state illustrated in FIG. 6, the bosses 34*y*, 34*m*, and 34*c* are released from the state of contact with the respective contact surfaces 41*y*, 41*m* and 41*c*, as illustrated in FIG. 8. As a result, the primary transfer rollers 20*y*, 20*m*, and 20*c* are moved toward the intermediate transfer belt 21 due to the urging forces of the primary transfer springs 32, as is the case for the primary transfer roller 20*k*. The primary transfer rollers 20*y*, 20*m*, and 20*c* press the corresponding photosensitive drums 5 with the intermediate transfer belt 21 interposed therebetween, thereby forming the primary transfer portions N1*y*, N1*m*, and N1*c*. Thus, in the state illustrated in FIG. 8, the primary transfer portions N1*y*, N1*m*, N1*c*, and N1*k* and the secondary transfer portion N2 are formed.

When the primary transfer and the secondary transfer are finished in the full-color mode, the separation shaft unit 29 is rotated by 120 degrees in the direction of arrow H (counterclockwise) at a predetermined timing. Consequently, rotation of the first cams 38 causes the large levers 41 to move in the direction of arrow E. At this time, rotation of the second cams 39 also causes the small levers 42 to move in the direction of arrow E. Here, the direction of arrow E is the direction substantially parallel to a moving direction of the intermediate transfer belt 21 at the primary transfer portion N1, and is the direction opposite to the direction of arrow D.

As a result, the bosses 34*y*, 34*m*, 34*c*, and 34*k* are brought into contact with the respective contact surfaces 41*y*, 41*m*, 41*c*, and 42*k*, and the primary transfer rollers 20 are thereby switched from the state of pressing against the corresponding photosensitive drums 5 and the intermediate transfer belt 21. Simultaneously, the rotation of the separation cams 43 causes the pressing portions 43*b* to press the contact surfaces 26*a*. As a result, all of the primary transfer rollers 20 and the secondary transfer roller 25 are separated from the intermediate transfer belt 21. Thus, the transfer unit 10 assumes the state of standby or power-off as illustrated in FIG. 6.

In the present embodiment, as described above, the separation cam 43 for the separation of the secondary transfer roller 25 is formed so as to be able to rotate about the shaft 24*a* of the opposing roller 24. This enables the shaft 24*a* of the opposing roller 24 to receive the load applied to the separation cam 43 when the secondary transfer roller 25 is separated. The shaft 24*a* of the opposing roller 24 is often formed as a metal shaft having a high rigidity so as to withstand the urging force of each spring 27 used to form the secondary transfer portion N2.

Accordingly, the shaft 24*a* of the opposing roller 24 receives the load applied to the separation cam 43 in the present embodiment, which disperses the opposing force acting against the separation cam 43, in other words, the urging force of the spring 27, and can prevent deformation of the separation cams 43 due to creep. As a result, even in the case of adopting a large pressing force of the secondary transfer roller 25 acting on the opposing roller 24 and the intermediate transfer belt 21, the durability of the separation unit that withstands the load acting during separating the secondary transfer roller 25 can be improved.

Moreover, in the present embodiment, the rotation axis of the secondary transfer roller 25, the pressing portion 43*b*, and the shaft 24*a* of the opposing roller 24 are disposed substantially on a straight line when viewed in the direction of the rotation axis of the secondary transfer roller 25 in the state illustrated in FIG. 6. Due to this arrangement, the urging force of each spring 27 can be dispersed more efficiently.

In addition, in the present embodiment, the rotating shaft 42*a* of each small lever 42 is linked with the link portion 43*c* of the separation cam 43. By using this mechanism, rotation of the separation shaft unit 29 causes the primary transfer rollers 20 and the secondary transfer roller 25 to separate from the intermediate transfer belt 21. In other words, in the present embodiment, the separation unit that includes the separation shaft unit 29, the large levers 41, the small levers 42, and separation cams 43 can separate the primary transfer rollers 20 and the secondary transfer roller 25 from the intermediate transfer belt 21. The separation unit uses a common separation mechanism for separating the primary transfer rollers 20 from the intermediate transfer belt 21 and for separating the secondary transfer roller 25 from the intermediate transfer belt 21, which can contribute to further downsizing, space saving, and cost reduction of the image forming apparatus.

In addition, in the present embodiment, the cam shape adopted for the separation cam 43 can reduce the distance required for each small lever 42 moving to separate the secondary transfer roller 25. As a result, the second cam 39 can be made small, which further contributes to downsizing and space saving of the image forming apparatus.

Moreover, in the present embodiment, the contact surface 26*a* of the secondary transfer bearing 26, which is pressed by the pressing portion 43*b* of the separation cam 43, is formed as an arc surface. By forming the contact surface 26*a* as an arc surface instead of a flat surface, the separation cam 43 can rotate smoothly.

Note that in the present embodiment, roller members are used as the transfer members that primary- and secondary-transfer an image onto the intermediate transfer belt 21 and onto a transfer medium. However, the transfer member is not limited to this configuration. For example, a member other than the roller member, such as a brush or a pad, may be used as the transfer member to obtain the same advantageous effects.

Moreover, the primary transfer member according to the present embodiment is formed of an elastic material, such as foam rubber. However, a metal roller that does not have an elastic layer can be used for the primary transfer member. In this case, the metal roller is disposed, in the moving direction of the intermediate transfer belt 21, upstream or downstream of each primary transfer portion N1 in which the corresponding photosensitive drum 5 is in contact with the intermediate transfer belt 21. Thus, the primary transfer portion N1 can be formed stably while suppressing deterioration of the photosensitive drum 5.

Second Embodiment

The configuration and operation of the separation unit in the first embodiment have been described, in which rotation of the separation shaft unit 29 of the separation unit causes the primary transfer rollers 20 and the secondary transfer roller 25 to separate from the intermediate transfer belt 21. On the other hand, in a second embodiment, the timing at which the primary transfer rollers 20 are separated from the intermediate transfer belt 21 is shifted from the timing at which the secondary transfer roller 25 is separated from the intermediate transfer belt 21. This configuration will be described with reference to the FIGS. 9A to 9C. Note that in the present embodiment, components common to those described in the first embodiment are denoted by the same reference symbols, and duplicated description will be omitted.

Figure 9A:
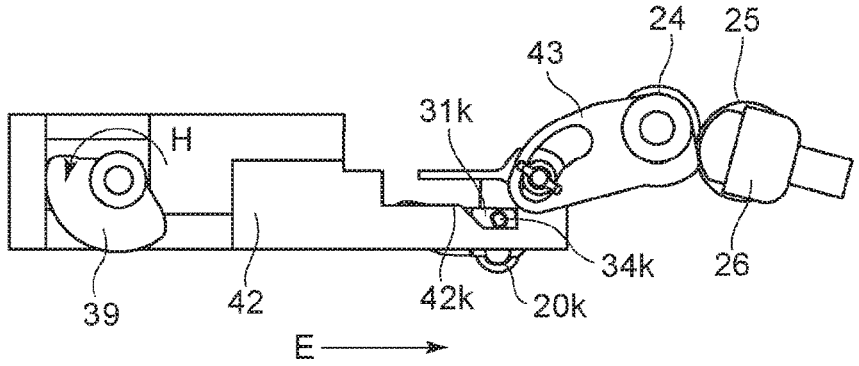
FIGS. 9A to 9C are diagrams each illustrating a positional relationship of components at various timings while the separation unit separates the primary transfer member and the secondary transfer member in the second embodiment.
Figure 9B:
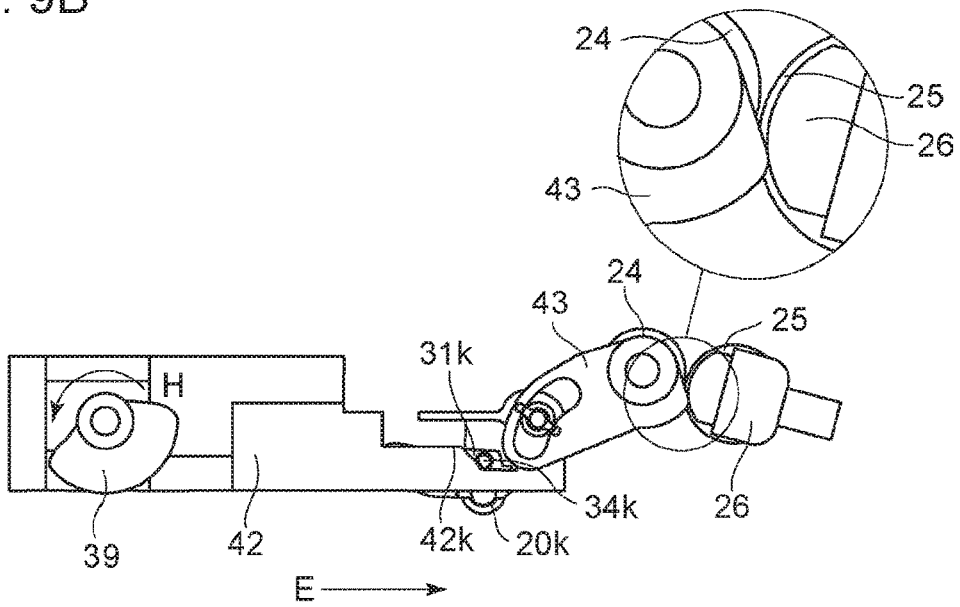
Figure 9C:
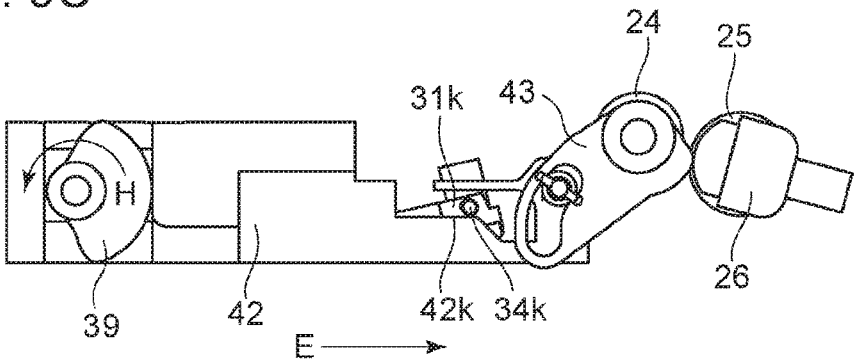

FIGS. 9A to 9C are diagrams illustrating separation of the primary transfer roller 20*k* and the secondary transfer roller 25 according to the present embodiment. As described in the first embodiment, when the image forming in the full-color mode is finished, the separation shaft unit 29 is rotated in the direction of arrow H at a predetermined timing as illustrated in FIG. 8, and the primary transfer rollers 20 and the secondary transfer roller 25 are thereby separated. Note that when the image forming in the monochrome mode is finished, the separation shaft unit 29 is rotated in the direction of arrow H from the state illustrated in FIG. 7, and the primary transfer rollers 20 and the secondary transfer roller 25 are consequently separated via the state of the full-color mode in FIG. 8. In other words, in the present embodiment, the transfer unit 10 performs separation of the primary transfer rollers 20 and the secondary transfer roller 25 by rotating the separation shaft unit 29 from the state illustrated in FIG. 8.

FIG. 9A is a diagram illustrating the separation cam 43 and the small lever 42 according to the present embodiment, which are in the state illustrated in FIG. 8. In this state, the primary transfer rollers 20 and the secondary transfer roller 25 are in contact with the intermediate transfer belt 21 as illustrated in FIG. 8, and the second cam 39 is in contact with the small lever 42 as illustrated in FIG. 9A. When the separation shaft unit 29 is rotated in the direction of arrow H from the state in FIG. 9A, the small lever 42 is moved in the direction of arrow E, and the transfer unit 10 assumes the state illustrated in FIG. 9B.

At this time, the separation cam 43 rotates in conjunction with the movement of the small lever 42 and starts to press the secondary transfer roller 25 in a direction away from the intermediate transfer belt 21. Meanwhile, the primary transfer roller 20*k* is positioned in contact with the intermediate transfer belt 21 while the boss 34*k* of the primary transfer bearing 31*k* is in contact with the small lever 42. In other words, in the present embodiment, the separation cam 43 starts to rotate before the pressing state of the primary transfer roller 20*k* is switched, by the movement of the small lever 42, from the state of pressing the intermediate transfer belt 21 against the photosensitive drum 5*k*. Thus, the secondary transfer roller 25 is separated from the intermediate transfer belt 21 before the primary transfer roller 20*k* is separated from the intermediate transfer belt 21.

Subsequently, the separation shaft unit 29 is rotated further in the direction of arrow H, and the state in FIG. 9B is thereby changed to the state in FIG. 9C. While the small lever 42 moves further in the direction of arrow E, the boss 34*k* of the primary transfer bearing 31*k* moves along the slope of the contact surface 42*k*. As a result, the primary transfer roller 20*k* is separated from the intermediate transfer belt 21. At this time, the primary transfer rollers 20*y*, 20*m*, and 20*c*, which are formed so as to separate from the intermediate transfer belt 21 by the first separation cam 38 and the large lever 41, are separated substantially at the same timing at which the primary transfer roller 20*k* is separated from the intermediate transfer belt 21.

As described above, the secondary transfer roller 25 is separated from the intermediate transfer belt 21 before the primary transfer rollers 20 are separated. This reduces the maximum torque applied to the components of the separation unit at the timing of separation. As a result, the advantageous effects similar to those in the first embodiment can also be obtained, and the durability of the separation unit can be further improved.

Note that in the present embodiment, the timing of separation of the primary transfer rollers 20 and the secondary transfer roller 25 is changed by altering the shape of the small lever 42, and the separation timing of the four primary transfer rollers 20 are set substantially the same. However, the timing of separation of the primary transfer rollers 20*y*, 20*m*, and 20*c* and the secondary transfer roller 25 and the primary transfer roller 20*k* may be changed by adjusting the phases of the first cam 38 and the second cam 39. By changing the separation timing of each of the primary transfer rollers 20 in such a manner, the maximum torque applied to the components of the separation unit can be further reduced at the timing of separation.

It has been described in the present embodiment that the secondary transfer roller 25 is separated from the intermediate transfer belt 21 before the primary transfer rollers 20 are separated from the intermediate transfer belt 21. However, the primary transfer rollers 20 may be separated from the intermediate transfer belt 21 before the secondary transfer roller 25 is separated from the intermediate transfer belt 21 by switching the pressing state of the primary transfer rollers 20 before the separation cam 43 starts to rotate.

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of Japanese Patent Application No. 2017-187131 filed Sep. 27, 2017, which is hereby incorporated by reference herein in its entirety.

What is claimed is:

1. An image forming apparatus comprising:

an image bearing member configured to bear a toner image;

a transfer belt that is movable and comes into contact with the image bearing member;

a first contact member that comes into contact with an inner peripheral surface of the transfer belt and is configured to press the transfer belt toward the image bearing member;

a secondary transfer member that comes into contact with an outer peripheral surface of the transfer belt and thereby forms a secondary transfer portion;

an opposing member that is disposed at a position opposing the secondary transfer member with the transfer belt interposed therebetween;

an urging member configured to urge the secondary transfer member toward the opposing member; and a separation unit configured to separate the transfer belt from the image bearing member by switching a pressing state of the first contact member, wherein the separation unit includes a rotating member that rotates about a rotation axis of the opposing member and thereby moves the secondary transfer member in a direction opposite to an urging direction of the urging member and separates the secondary transfer member from the transfer belt.

2. The image forming apparatus according to claim 1, wherein the separation unit includes a first moving member configured to switch the pressing state of the first contact member by moving in a direction substantially parallel to a moving direction of a contacting position of the transfer belt, the contacting position of the transfer belt being contacted with the image bearing member, and the first moving member moves the first contact member in a direction away from the transfer belt by switching the pressing state of the first contact member and thereby separates the transfer belt from the image bearing member.

3. The image forming apparatus according to claim 2, wherein the first moving member has an engaging portion that engages with an engaged portion provided in the rotating member, and the first moving member moves in the moving direction of the contacting position in a state where the engaging portion and the engaged portion engage each other, and thereby the rotating member rotates about the rotation axis.

4. The image forming apparatus according to claim 2, wherein the separation unit moves the first moving member in a direction opposite to the moving direction of the contacting position and thereby brings the secondary transfer member into contact with the transfer belt and brings the first contact member into contact with the transfer belt.

5. The image forming apparatus according to claim 2, wherein a timing at which the pressing state of the first contact member is switched by movement of the first moving member is different from a timing at which the rotating member starts to rotate.

6. The image forming apparatus according to claim 2, wherein the separation unit separates the secondary transfer member from the transfer belt before separating the transfer belt from the image bearing member.

7. The image forming apparatus according to claim 2, further comprising:

a second image bearing member configured to bear a toner image of a color different from that of the toner image born by the image bearing member; and a second contact member that is disposed at a position corresponding to the second image bearing member, wherein the separation unit includes a second moving member configured to move the second contact member in a direction away from the transfer belt by switching a pressing state of the second contact member and thereby separates the transfer belt from the second image bearing member, and movement of the first moving member and the second moving member in the moving direction of the contacting position separates the first contact member and the second contact member from the transfer belt.

8. The image forming apparatus according to claim 1, further comprising:

a bearing member configured to support each of opposite ends of the secondary transfer member with respect to a direction intersecting a conveying direction of a transfer medium, wherein the rotating member including a pressing portion configured to press a contact surface of the bearing member, and the separation unit rotates the rotating member and causes the pressing portion to press the contact surface and thereby moves the secondary transfer member in a direction opposite to an urging direction of the urging member.

9. The image forming apparatus according to claim 8, wherein the urging member urges the bearing member and thereby urges the secondary transfer member toward the opposing member.

10. The image forming apparatus according to claim 8, wherein in a state where the secondary transfer member is separated from the transfer belt due to the pressing portion pressing the contact surface, an axial center of the secondary transfer member, the pressing portion, and an axial center of the opposing member are disposed substantially along a straight line when viewed in an axial direction of the secondary transfer member.

11. The image forming apparatus according to claim 1, wherein the rotating member is a cam disposed on a shaft of the opposing member and rotates about the shaft.

12. A transfer unit that can be mounted in, and detached from, an image forming apparatus that includes a secondary transfer member and an urging member that urges the secondary transfer member, the transfer unit comprising:

a transfer belt that is movable;

a contact member that comes into contact with an inner peripheral surface of the transfer belt and configured to press the transfer belt toward an image bearing member provided in the image forming apparatus;

an opposing member that is disposed at a position opposing the secondary transfer member with the transfer belt interposed therebetween; and a separation unit configured to separate the transfer belt from the image bearing member, in a state where the transfer unit is mounted on the image forming apparatus, by switching a pressing state of the contact member, wherein the separation unit includes a rotating member that rotates about a rotation axis of the opposing member and thereby moves, in a direction opposite to an urging direction of the urging member, the secondary transfer member that is urged toward the opposing member by the urging member and separates the secondary transfer member from the transfer belt.

13. The transfer unit according to claim 12, wherein the separation unit includes a first moving member configured to switch the pressing state of the contact member by moving in a direction substantially parallel to a moving direction of a contacting position of the transfer belt, the contacting position of the transfer belt being contacted with the image bearing member, and the first moving member moves the contact member in a direction away from the transfer belt by switching the pressing state of the contact member and thereby separates the transfer belt from the image bearing member.

14. The transfer unit according to claim 13, wherein the first moving member has an engaging portion that engages an engaged portion provided in the rotating member, and the first moving member moves in the moving direction of the transfer belt in a state where the engaging portion and the engaged portion engage each other, and thereby the rotating member rotates about the rotation axis.

15. The transfer unit according to claim 13, wherein the rotating member including a pressing portion configured to press a contact surface provided on a bearing member that supports each of opposite ends of the secondary transfer member, and the separation unit rotates the rotating member and causes the pressing portion to press the contact surface and thereby moves the secondary transfer member in a direction opposite to an urging direction of the urging member and separates the secondary transfer member from the transfer belt.

16. The transfer unit according to claim 13, wherein the separation unit moves the first moving member in a direction opposite to the moving direction of the contacting position and thereby brings the secondary transfer member into contact with the transfer belt and brings the contact member into contact with the transfer belt.

17. The transfer unit according to claim 13, wherein a timing at which the pressing state of the contact member is switched by movement of the first moving member is different from a timing at which the rotating member starts to rotate.

18. The transfer unit according to claim 12, wherein the rotating member is a cam disposed on a shaft of the opposing member and rotates about the shaft.

* * * * *